US006916149B2

(12) United States Patent
Liou

(10) Patent No.: US 6,916,149 B2
(45) Date of Patent: Jul. 12, 2005

(54) VORTEX BLOWER

(76) Inventor: Un-Fei Liou, 5F., No. 339, Sec. 4, Wunsin Rd., Beitun District, Taichung City (TW)

( * ) Notice: Subject to any disclaimer, the term of this patent is extended or adjusted under 35 U.S.C. 154(b) by 0 days.

(21) Appl. No.: 10/609,589

(22) Filed: Jul. 1, 2003

(65) Prior Publication Data

US 2005/0002807 A1 Jan. 6, 2005

(51) Int. Cl.[7] ..... F04D 29/58
(52) U.S. Cl. ..... 415/55.1; 415/175; 417/423.8
(58) Field of Search ..... 415/55.1–55.6, 415/175–176, 206; 417/423.8, 368; 310/63

(56) References Cited

U.S. PATENT DOCUMENTS 4,742,257 A * 5/1988 Carpenter ..... 310/62
5,081,384 A * 1/1992 Rausch ..... 310/63
5,714,816 A * 2/1998 Jensen et al. ..... 310/89
5,780,946 A * 7/1998 Nakamura et al. ..... 310/58
6,439,843 B1 * 8/2002 Finkenbinder ..... 415/172.1
6,474,981 B1 * 11/2002 Morgan ..... 431/350

* cited by examiner

*Primary Examiner*—Edward K. Look
*Assistant Examiner*—Richard A Edgar
(74) *Attorney, Agent, or Firm*—Bacon & Thomas, PLLC

(57) ABSTRACT

A vortex blower is composed of a motor providing a rotating power and including a pivot, a first rear housing mounted in proximity of the pivot and including two through holes at a lower side thereof for communicating respectively with an entrance airway and an exit airway, an impeller mounted inside the first rear housing and on the pivot and rotating along with the shaft, a second rear housing including a through hole at the center thereof and covers on the first rear housing to enable the pivot to run through the through hole and to enable the impeller to be encased inside the first and second rear housings, and a heat-dissipating device mounted outside the second rear housing and is driven by the pivot to work and to generate rapid flowing air outside the first and second rear housings.

6 Claims, 6 Drawing Sheets

VORTEX BLOWER

BACKGROUND OF THE INVENTION

1. Field of the Invention

The present invention relates generally to vortex blowers, and more particularly, to a vortex blower capable of effective heat-dissipation.

2. Description of the Related Art

A conventional vortex blower, as shown in FIGS. 1 and 2, is composed of a motor 10, a housing 11, a bearing (not shown), an impeller (not shown), an entrance airway 12 and an exit airway 13 both in communication with the housing 11. In operation, the motor 10 drives the impeller mounted inside the housing 11 to rotate in high speed, thereby generating high-pressured wind which flows through the airway 13 and towards outside. However, when the vortex blower is operated to run for a while (3–5 minutes or so), the friction generated by high-speed rotation of the impeller and the bearing cause the air inside the housing to be heated to high temperature of 100–120° C. or so. In the meantime, the output wind becomes very hot due to the inside high temperature to liquidize the milky lubricant inside the bearing, thereby causing dramatic reduction of the lubrication generated by the lubricant and worked on the bearing, and further easily rendering wear and tear and even damage of the bearing.

Furthermore, the high temperature inside the housing enables the increased expansion and the reduced density of the inside air to cause the output wind pressure smaller than that in normal temperature, such that the blower is defective in insufficient wind pressure. In addition, while the blower is used in particular situations, like agricultural and fishing breeding, the output high-temperature wind will hurt those animals and plants in the agricultural and fishing breeding. Although the current solution to puzzle out this problem is to mount a plurality of ribs on the housing for enlarging the surface area of the housing, which helps to dissipate heat, this solution inefficiently improves the problem.

SUMMARY OF THE INVENTION

The primary objective of the present invention is to provide a vortex blower, which can reduce the temperature of its output wind.

The foregoing objective of the present invention is attained by the vortex blower, which is composed of a motor, a first rear housing, an impeller, a second rear housing, and a heat-dissipating device. The motor is electrically driven to rotate for providing a rotating power and includes a pivot protruded outwards from a side thereof. The first rear housing is mounted on the side of the motor where the pivot is protruded outwards and includes two through holes at a lower side thereof for communicating respectively with an entrance airway and an exit airway. The impeller is mounted on the pivot and is rotated along with the shaft. The second rear housing includes a through hole at the center thereof and is connected with the first rear housing to enable the pivot to run through the through hole and to enable the impeller to be encased inside the first and second rear housings. The heat-dissipating device is mounted outside the second rear housing and is driven by the pivot to work and to generate rapid flowing air outside the first and second housings.

DETAILED DESCRIPTION OF THE INVENTION

Figure 1:
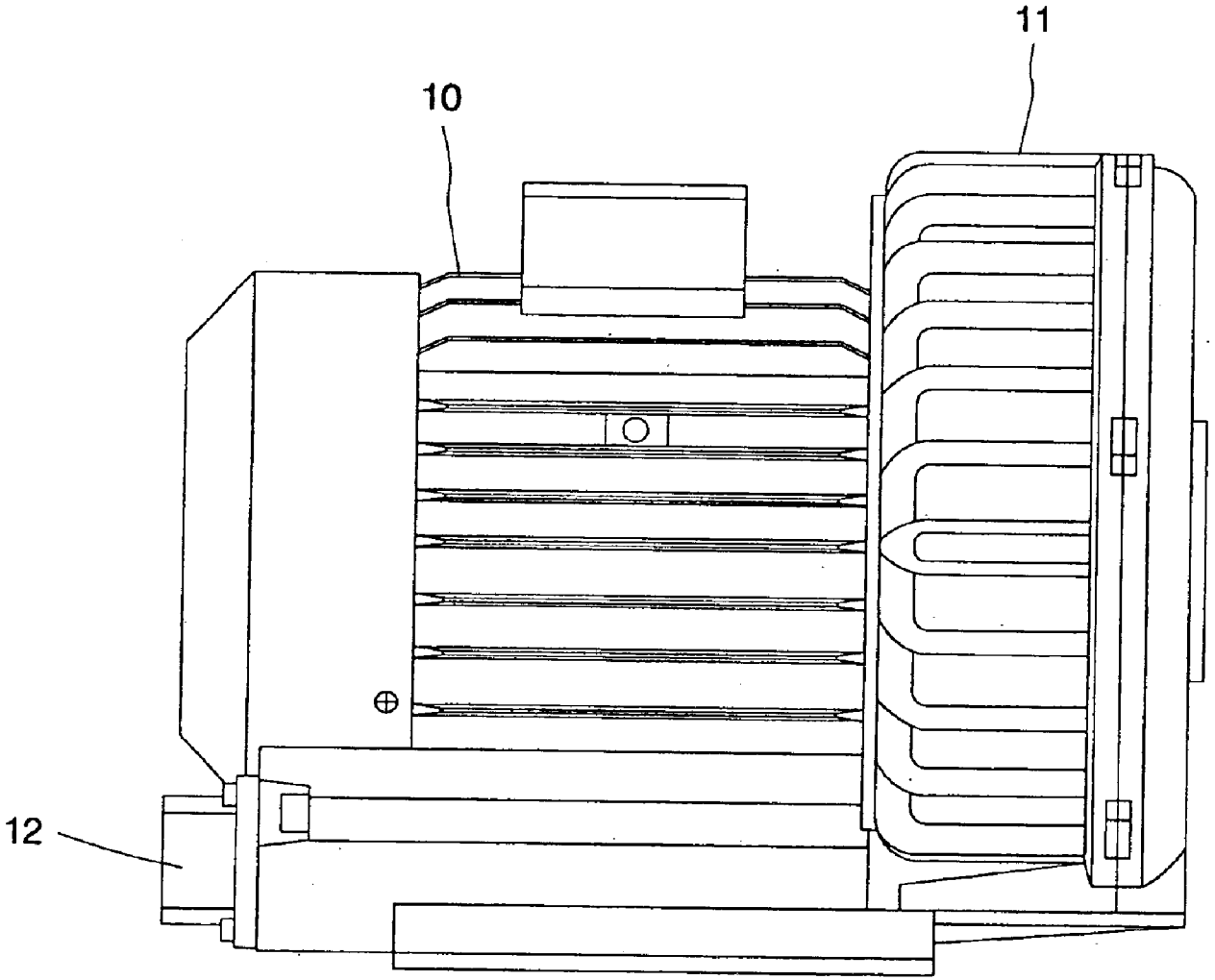
FIG. 1 PRIOR ART
FIG. 1 is a side view of a prior art.
Figure 2:
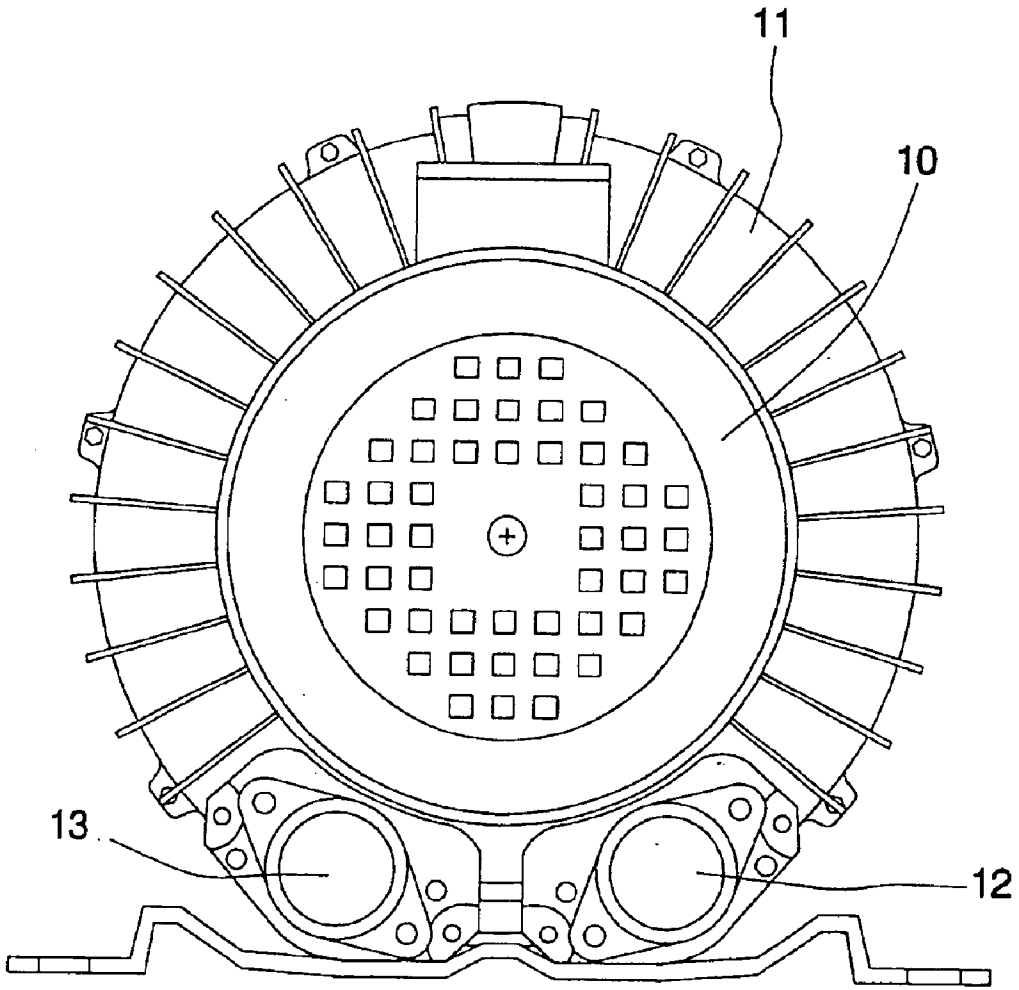
FIG. 2 PRIOR ART
FIG. 2 is an elevational view of the prior art.
Figure 3:
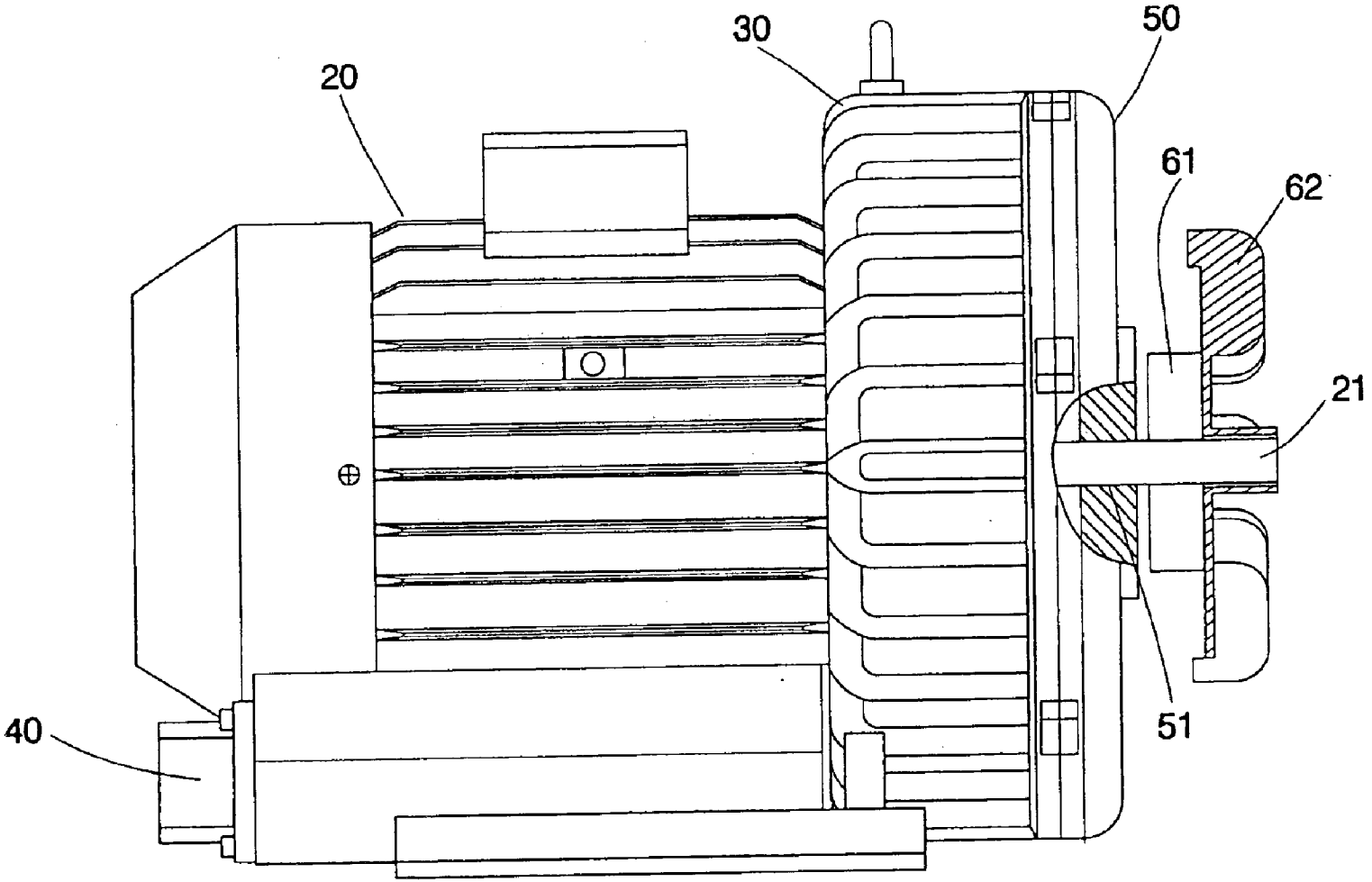
FIG. 3 is a side view of a first preferred embodiment of the present invention without a cover shell.
Figure 4:
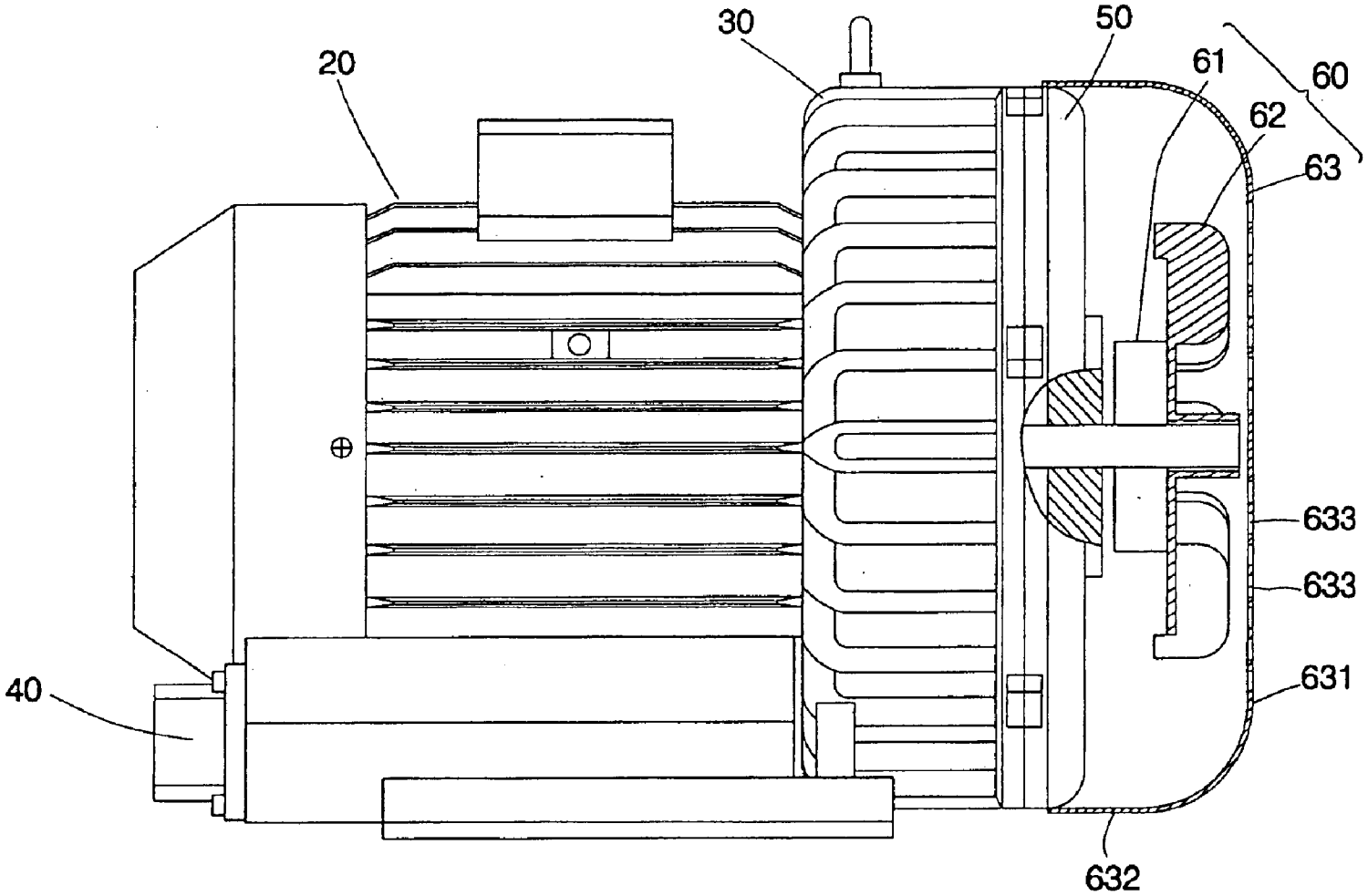
FIG. 4 is a side view of the first preferred embodiment of the present invention.

Referring to FIGS. 3–4, a vortex blower constructed according to a first embodiment of the present invention is composed of a motor 20, a first rear housing 30, an entrance airway 40 and an exit airway 41, an impeller (not shown), a second rear housing 50, and a heat-dissipating device 60.

The motor 20 is electrically driven to rotate for providing a rotating power and includes a pivot 21 protruded outwards from a side thereof.

The first rear housing 30 is mounted at the side of the motor where the pivot 21 is protruded outwards and includes two through holes at a lower side thereof.

The entrance and exit airways 40 and 41 are respectively disposed at bilateral sides of the motor 20 and in communication with the two through holes of the first rear housing 30.

The impeller (not shown) is mounted on the pivot 21 and received inside the first rear housing 30 to rotate along with the pivot 21.

The second rear housing 50 is saucer-like and includes a through hole 51 at the center thereof. The second rear housing 50 covers on the first rear housing 30 to enable the pivot 21 to run through the through hole 51 and to enable the impeller (not shown) to be encased inside the first and second rear housings 30 and 50.

The heat-dissipating device 60 is mounted outside the second rear housing 50 and is driven by the pivot 21 to generate rapid flowing air outside the second rear housing 50, thereby rendering heat-dissipative effect. In this embodiment, the heat-dissipating device 60 includes a wheeling member 61, a blade 62, and a cover shell 63. The wheeling member 61 is mounted on the pivot 21. The blade 62 is mounted on the wheeling member 61. The wheeling member 61 and the blade 62 can be rotated along with the pivot 21. The cover shell 63 is provided with a saucer-like bottom 631, an annular wall 632 extending from a peripheral edge of the bottom 631, and a plurality of through holes running through the bottom 631. The cover shell 63 is substantially equal to the second rear housing 50 in size to be mounted on the second rear housing 50 and to encase the impeller 62.

While the vortex blower of the present invention is operated, the blade 62 will rotate along with the impeller and then the rapid flowing air will be generated outside the second rear housing 50 to render heat-dissipation working on the surface of the second rear housing 50, thereby effectively reducing the temperature of the surface of second rear housing 50 and further reducing the temperature of the output air.

Figure 5:
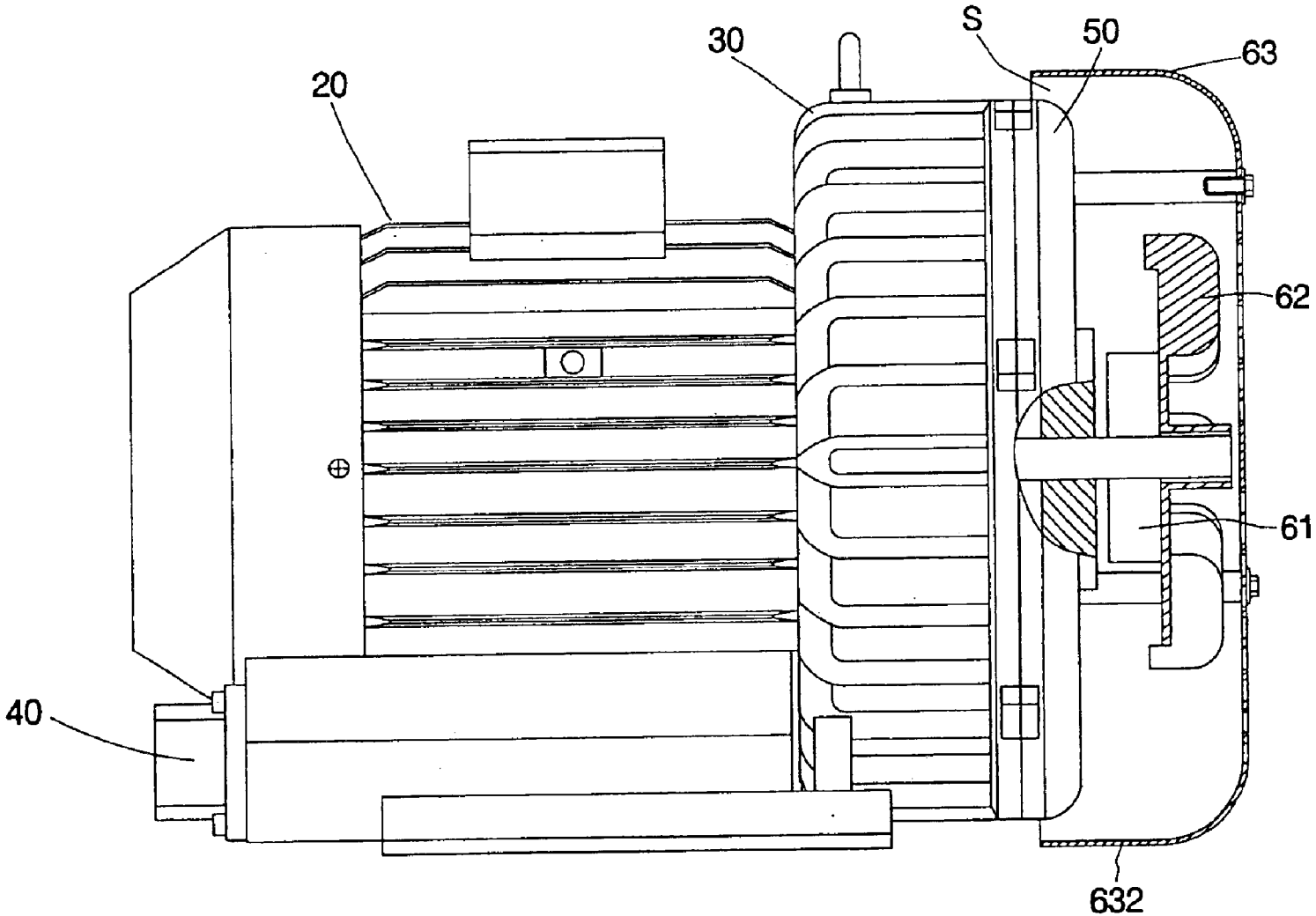
FIG. 5 is a side view of a second preferred embodiment of the present invention.
Figure 6:
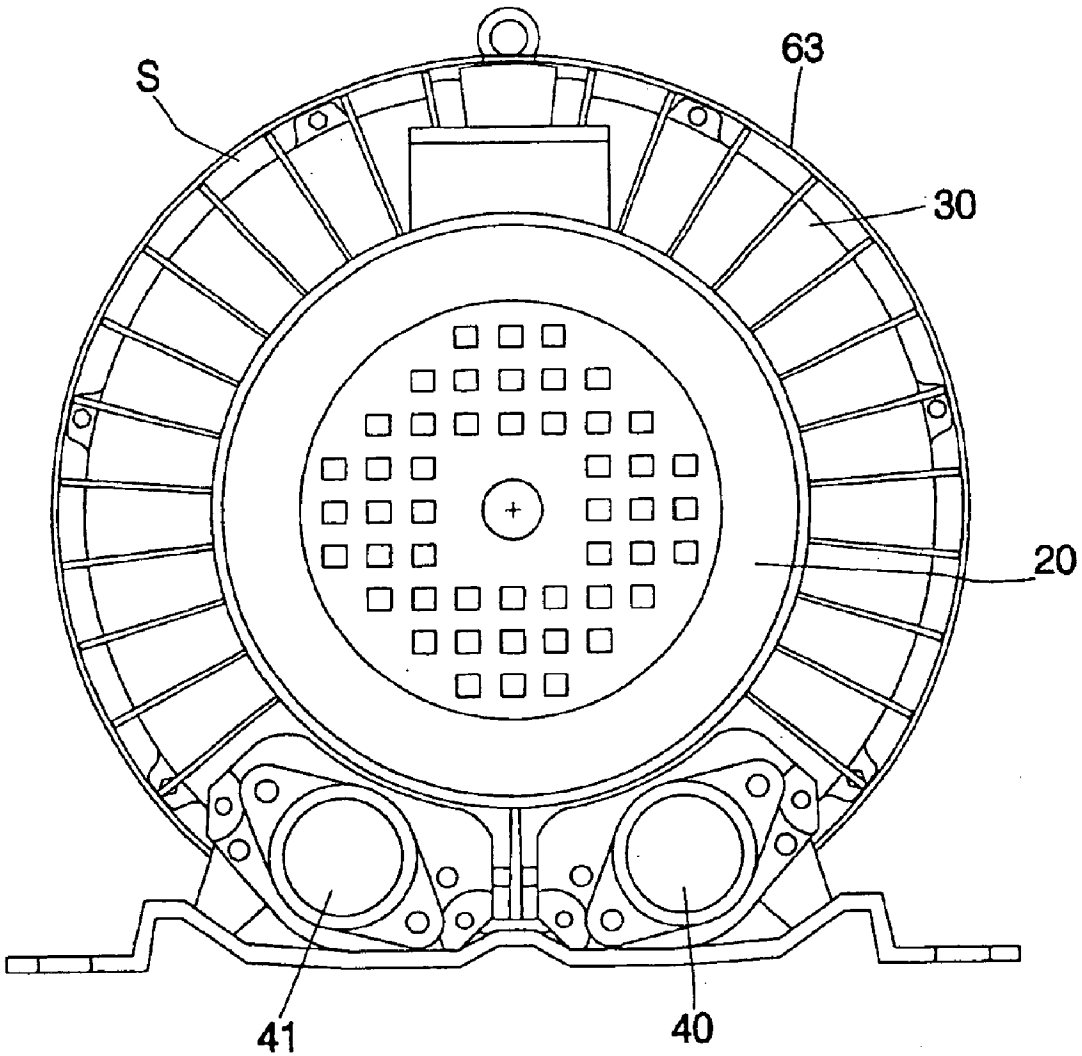
FIG. 6 is an elevational view of the second preferred embodiment of the present invention.

Referring to FIGS. 5–6, the vortex blower constructed according to a second embodiment of the present invention is different from the first preferred embodiment only in that the cover shell 63 is respectively larger than the first and second rear housings 30 and 50 in size, such that an annular gap S is formed between the annular wall 632 and the second rear housing 50 to facilitate the circulation of the output wind and to preferably reduce the temperature of the output wind.

Alternatively, the heat-dissipating device 60 of the present invention includes a blade assembly having two or more blades 62 except one single blade 62. The blade assembly can be indirectly driven by the pivot 21 via gears to rotate.

Here after in the chart 1 and chart 2 show the experiment information by the normal vortex blower and present invention. There is a reality showing out very clearly that the temperature of the normal vortex blower will go high as the time passed. The pressure of the normal vortex blower will go down according with the temperature going high. But the temperature will be controlled under an expectative level of present invention and the pressure will not go down so far according with the temperature going high. These data can exact prove the efficiency of present invention.

| EXPERIMENT ENVIRONMENT | Order | Cumulus Time (min) | Temp of the shell (° C.) | Temp of the exit (° C.) | Net Pressure (mmAq) |
|---|---|---|---|---|---|
| Vortex blower without the heat-dissipating device | | | | | |
| AIR PRESSURE: | 1 | 0 | 39.2 | 42.5 | 2005 |
| 743 mmAq | 2 | 5 | 72.4 | 77.1 | 1335 |
| Env. Temp: | 3 | 15 | 83.7 | 84.4 | 920 |
| 30.5° C. | 4 | 30 | 89.9 | 90.7 | 650 |
| Humidity: 68% | 5 | 60 | 91.2 | 92.3 | 645 |
| | 6 | 90 | 91.1 | 92.4 | 645 |
| Vortex blower with the heat-dissipating device | | | | | |
| AIR PRESSURE: | 1 | 0 | 38.3 | 40.3 | 2000 |
| 743 mmAg | 2 | 5 | 45.7 | 58.1 | 1670 |
| Env. Temp: | 3 | 15 | 48.6 | 67.7 | 1500 |
| 30.5° C. | 4 | 30 | 52.4 | 72.5 | 1340 |
| Humidity: 68% | 5 | 60 | 58.1 | 72.2 | 1340 |
| | 6 | 90 | 57.9 | 72.2 | 1345 |

What is claimed is:

1. A blower comprising:

a motor electrically driven to rotate for providing a rotating power, said motor having a pivot protruded outwards from a side thereof;

an impeller housing including a first rear cover and a second rear cover;

the first rear cover mounted at the side of said motor where said pivot is protruded outwards;

an entrance airway and an exit airway mounted at a side of said motor and in communication respectively with two through holes of said first rear cover; a n impeller mounted on said pivot and received in impeller housing to rotate along with said pivot;

the second rear cover being saucer-like and having a through hole at the center thereof, said second rear housing being mounted to said first rear housing to enable said pivot to run through said through hole thereof and to encase said impeller; and a heat-dissipating device mounted outside said second rear housing and driven by said pivot to generate rapid flowing air outside said second rear housing.

2. The blower as defined in claim 1, wherein said heat-dissipating device further comprises a blade mounted on said pivot to rotate along with the pivot.

3. The blower as defined in claim 2, wherein said heat-dissipating device further comprises a cover shell, said cover shell encasing said blade.

4. The blower as defined in claim 3, wherein said cover shell comprises a saucer-like bottom, an annular wall extending from a peripheral edge of said bottom, and a plurality of through holes running through said bottom.

5. The blower as defined in claim 4, wherein said cover shell is larger respectively than said first and second rear housing in size to form an annular gap between said annular wall and said second rear housing.

6. The blower as defined in claim 2, wherein said heat-dissipating device comprises a wheeling member mounted on said pivot; said blade is mounted on said wheeling member.

* * * * *